US006986326B1

(12) United States Patent
Rosenzweig et al.

(10) Patent No.: US 6,986,326 B1
(45) Date of Patent: Jan. 17, 2006

(54) ADDITIONAL SECURITY FOR A STEAM BOILER

(75) Inventors: Max Rosenzweig, Atwater (CA); Terry Robertson, Auburn, AL (US); Mark Montgomery, West Newton, MA (US)

(73) Assignee: Euro-Pro Operating, LLC, West Newton, MA (US)

( * ) Notice: Subject to any disclaimer, the term of this patent is extended or adjusted under 35 U.S.C. 154(b) by 0 days.

(21) Appl. No.: 11/081,828

(22) Filed: Mar. 17, 2005

(51) Int. Cl.
*F22B 37/44* (2006.01)

(52) U.S. Cl. ..... 122/507; 122/504; 137/312

(58) Field of Classification Search ..... 122/504, 122/505, 506, 507; 137/312, 313
See application file for complete search history.

(56) References Cited

U.S. PATENT DOCUMENTS

| | | | | |
|---|---|---|---|---|
| 904,984 | A | 11/1908 | Ofeldt | |
| 3,200,839 | A | 8/1965 | Gallagher | |
| 3,279,749 | A | 10/1966 | Fleckenstein et al. | |
| 3,307,568 | A | 3/1967 | Gartner | |
| 3,520,321 | A | 7/1970 | Skoli et al. | |
| 3,606,908 | A | 9/1971 | Riester | |
| 3,636,969 | A | 1/1972 | Jacobellis | |
| 3,818,874 | A * | 6/1974 | Tria | 122/504 |
| 3,918,470 | A | 11/1975 | Jacobellis | |
| 3,980,131 | A * | 9/1976 | Perle et al. | 165/61 |
| 4,168,723 | A | 9/1979 | Schneider | |
| 4,285,302 | A * | 8/1981 | Kelly | 122/382 |
| 4,495,899 | A * | 1/1985 | Carberry | 122/504 |
| 6,647,204 | B1 * | 11/2003 | Hutchinson | 392/491 |

* cited by examiner

*Primary Examiner*—Gregory Wilson
(74) *Attorney, Agent, or Firm*—Venable LLP; Ralph P. Albrecht; Stuart I. Smith

(57) ABSTRACT

A steam generation apparatus is set forth including a housing; a boiler adapted to generate steam within the housing; a filler cap adapted to be removably coupled to the boiler; a first pressure relief device coupled to the boiler adapted to release steam at a first pressure level; and a second pressure relief device coupled to the boiler adapted to release the steam at a second pressure level, where the second pressure level is higher than the first pressure level, the first pressure relief device is incorporated into and is made to vent into the filler cap, and the second pressure relief device is made to vent internally to the housing.

14 Claims, 6 Drawing Sheets

| No | PART NAME | PC |
|---|---|---|
| 1 | BODY (RIGHT) | 1 |
| 2 | BODY (LEFT) | 1 |
| 3 | TO WIND-UP COVERS | 2 |
| 4 | SMALL TOP COVER WASHER | 1 |
| 5 | TOP COVER WASHER FLANCE | 1 |
| 6 | 3x9,5 YSB PT NI SCREW | 2 |
| 7 | 3,5x11,5 YSB PT NI SCREW | 5 |
| 8 | LAMP WINDOWS | 1 |
| 9 | 3,5x11,5 TW PT NI SCREW | 1St |
| 10 | BODY STOPPER | 3 |
| 11 | 4x20 INBUS PT SCREW | 8 |
| 12 | BOILER FIXATION BEARING | 1 |
| 31 | ø8,5 HOSE CLAMPS | 2 |
| 32 | 270mm SILICONE HOSE TEXTILE (SHORT) | 1 |
| 33 | SAFETY CAP | 1 |
| 34 | BOILER OUTLET COUPLING | 1 |
| 35 | SMALL SILVER WIRE | 1 |
| 36 | BOILER | 1 |
| 37 | HEATING ELEMENT 'AL' BLOCK -(UL) | 1 |
| 38 | HEATING ELEMENT-(UL) | 1 |
| 39 | 13x2,5 SILICON O-RING | 3 |
| 40 | REZ. 'AL' BLOCK NUT | 2 |
| 41 | M4x8 SPOT WELDING SCREW | 2 |
| 42 | M4 TRACKED WASHER | 1 |
| 43 | M4 NUT | 3 |
| 44 | THERMOSTAT 155° | 1 |
| 45 | INSULATIONN | 1Tk |
| 46 | TERMINAL FUSE CLAMP | 1 |
| 47 | 7 Bar SECURITY VALVE | 1 |
| 48 | M4x14 YSB SCREW | 1 |
| 49 | BIG SILVER WIRE | 1 |
| 50 | BOILER INLET COUPLING | 1 |
| 51 | EP922 WATER TANK FIXING CLAMP | 1 |
| 71 | HOSE PROTECTOR FLANGE | 1 |
| 72 | ø8,5 HOSE CLAMPS | 1 |
| 73 | HOSE PROTECTOR | 1 |
| 74 | HOSE | 1 |
| 75 | 'CAUTION' LABEL | 1 |
| 76 | HOSE PROTECTOR | 1 |
| 77 | EPDM TUBE BRAIDED (LONG) | 1 |
| 78 | ø8,5 HOSE CLAMPS | 1 |
| 79 | TRIGGER LOCK | 1 |
| 80 | EPDM TUBE BRAIDED (SHORT) | 1 |
| 81 | TRIGGER | 1 |

| | | |
|---|---|---|
| 81 | TRIGGER | 1 |
| 82 | HOSE CONNECTING COUPLING | 1 |
| 83 | PLASTIC CLAMP | 1 |
| 84 | HANDLE COVER (RIGHT) | 1 |
| 85 | VALVE BODY | 1 |
| 86 | ø3,5x2 O-RING | 1 |
| 87 | SMALL PLASTIC WASHER | 1 |
| 88 | BIG SILICON WASHER | 1 |
| 89 | VALVE PISTON | 1 |
| 90 | VALVE SPRING | 1 |
| 91 | VALVE COVER | 1 |
| 92 | 2,2 x 9,5 YSB SHEET SCREW | 2 |
| 93 | 7,66x1,78 O-RING | 2 |
| 94 | ADAPTER PIPE | 1 |
| 95 | PIPE'S BUTTON & BRUSH LOCK SPRING | 1 |
| 96 | PIPE BUTTON | 1 |
| 97 | 3x12 YSB PT SCREW | 5 |
| 98 | HANDLE COVER (LEFT) | 1 |
| 99 | 3x27,5 YSB PT SCREW | 4 |
| 100 | HOSE BUSH | 2 |
| 101 | 22x45 TYPE LABEL | 1 |
| 102 | 2,5x105 CABLE STRING | 1 |
| 130 | FLOOR WINDOW SQUEEGEE | 1 |
| 131 | ø148x1,4 EPDM O-RING | 1 |
| 132 | SPONGY EPDM RUBBER | 1 |
| 133 | EPDM RUBBER | 1 |
| 134 | RUBBER CLAMP | 1 |
| 135 | 3x16YSB PT BLACK SCREW | 4 |
| 145 | LOCKED INNER PIPE | 2 |
| 146 | 7,66x1,78 O-RING | 4 |
| 147 | INNER PIPE | 2 |
| 148 | 7,66x1,78 O-RING | 4 |
| 149 | PIPE | 2 |
| 150 | PIPE BUTTON | 2 |
| 151 | PIPE'S BUTTON & BRUSH LOCK SPRING | 2 |
| 160 | (EP507) INTERNAL CABLES GROUP-(UL) | 1 |
| 161 | SIGNAL LAMP ENCLOSURE (SC 505) | 1 |
| 162 | NEON LAMP | 2 |
| 163 | 172°C THERMAL FUSE | 1 |
| 164 | CABLE PRESSURE SPRING | 2 |
| 170 | TERMINAL SOCKET | 1 |
| 171 | CABLE CLAMP | 1 |
| 172 | 3,5x11 YSB PT SCREW | 2 |
| 180 | POWER CORD 16 AWG-(UL) | 1 |
| 181 | POWER CORD PROTECTOR | 1 |

| | | |
|---|---|---|
| 182 | TRIPLED TERMINAL | 1 |
| 183 | 'Do NOT add' MAIN CORD STICKER | 1 |
| 184 | CLIP POWER CORD | 1 |
| 185 | SC507/508/509 FUNNEL | 1 |
| 186 | WHITE FUNNEL WASHER | 1 |
| 370 | FLOOR BRUSH ADAPTER | 1 |
| 371 | STEAM POCKET NOZZLE | 1 |
| 372 | STEAM POCKET BODY | 1 |
| 373 | STEAM POCKET LOCK PIN | 1 |
| 374 | 7,66x1,78 O-RING | 2 |
| 300 | BOILER GROUP-(UL) | 1 |
| 301 | BODY PLASTIC GROUP | 1 |
| 302 | HOSE GROUP WITH TRIGGER-(UL) | 1 |
| 303 | PIPE GROUP | 1 |
| 304 | FLOOR BRUSH GROUP | 1 |
| 305 | POWER CORD GROUP-(UL) | 1 |
| 306 | WINDOW SQUEEGEE GROUP | 1 |
| 307 | ACCESSORY (120°) ADAPTOR | 1 |
| 308 | DETAIL BRUSH | 2 |
| 309 | 22X40 TIP LABEL | 1 |
| 310 | INSTRUCTION MANUAL-(UL) | 1 |
| 311 | INNER BOX-(UL) | 1 |
| 312 | FOAM GROUP | 1Tk |
| 313 | TERMINAL SOCKET GROUP | 1 |
| 314 | CABLE GROUP-(UL) | 1Tk |
| 315 | SHOULDER STRAP | 1 |
| 316 | SC507/508/509 FUNNEL GROUP | 1 |
| 317 | POLYBAG (22x30cm) | 1 |
| 318 | STEAM POCKET TOWEL | 1 |

FIG. 4

ADDITIONAL SECURITY FOR A STEAM BOILER

BACKGROUND OF THE INVENTION

1. Field of the Invention

This invention pertains generally to boilers, and more particularly to steam boilers and safety devices for consumer steam boilers.

2. Related Art

Portable steamers which may be used for cleaning have become increasingly popular in recent years. Steaming devices used to apply steam to household objects are well known. The uses of the devices vary widely, and may include application of steam to drapes or other fabrics to ease wrinkles, and application of steam to objects to assist in cleaning the objects.

Conventionally, portable steamers can be battery-powered or can be electrically powered by a power cord which may be plugged in a conventional electric outlet. Typical steam devices may use the electrical power to power a heating element to heat water in a steam generation unit, or boiler. The heated water generates steam, which may be directed towards its intended destination through a nozzle which controls application of the steam. Nozzles may typically be disconnectable from the steam generation unit to allow different nozzles to be used, based on the object to be steamed. The nozzle may be closely coupled to the steam generation unit, or may be located at a distance from the steam generator and may be coupled by tubing or other steam transfer structures interconnecting the steam generator and discharge nozzles. Most steamers have a hose which may be used to transport the steam from the steam generation unit, or boiler, to the point of use of the steam.

Various safety mechanisms exist to guard against dangers of excess pressure buildup in a steam boiler.

One conventional safety feature prevents inadvertent release of steam when attaching or removing a hose, concentrator nozzle, or other accessories.

SUMMARY OF THE INVENTION

In accordance with an exemplary embodiment of the present invention, an improved boiler for use in a steam generating device may include a second pressure relief device calibrated to relieve pressure at a higher second pressure level than a conventional first pressure relief device in a filler cap which is calibrated to relieve pressure at a lower first pressure level.

According to an exemplary embodiment of the present invention, a steam generation apparatus may include: a housing; a boiler adapted to generate steam within the housing; a filler cap adapted to be removably coupled to the boiler; a first pressure relief device coupled to the boiler adapted to release steam at a first pressure level; and a second pressure relief device coupled to the boiler adapted to release the steam at a second pressure level, where the second pressure level is higher than the first pressure level, the first pressure relief device is incorporated into and is made to vent into the filler cap, and the second pressure relief device is made to vent internally to the housing.

According to one exemplary embodiment of the present invention, the boiler may be constructed of stainless steel; or aluminum.

According to one exemplary embodiment of the present invention, the first pressure relief device may include a spring type pressure release valve.

According to one exemplary embodiment of the present invention, the second pressure relief device may include a brass octagon valve threaded into a wall of the boiler.

According to one exemplary embodiment of the present invention, the boiler may be included as part of a steam cleaner; or an iron steam station.

According to another exemplary embodiment of the present invention, the first pressure level may be calibrated to release at approximately 4 Bar to 6 Bar of pressure.

According to one exemplary embodiment of the present invention, the second pressure level may be calibrated to release at a higher pressure level than the first pressure level. In one exemplary embodiment, the second pressure level may be approximately 10 Bar to 15 Bar.

According to one exemplary embodiment of the present invention, the steam generating apparatus may further include a thermostat. In an exemplary embodiment, the thermostat may include a temperature sensor proximate to the boiler and a control system adapted to shutoff a heating element of the boiler upon sensing a threshold temperature.

According to one exemplary embodiment of the present invention, the apparatus may further include a fuse proximate to the boiler adapted to cutoff power to a heating element of the boiler if a temperature in excess of a fuse melting temperature is exceeded.

According to another exemplary embodiment of the present invention, the apparatus may further include a water level sensor adapted to cutoff power to a heating element proximate to the boiler if a water level in the boiler falls below a threshold water level.

According to one exemplary embodiment of the present invention, the apparatus may further include a hose coupled to the boiler at an outlet; and a nozzle coupled to the hose. According to one exemplary embodiment of the present invention, the nozzle may include a steam pocket nozzle; a steam pocket body; and a steam pocket towel.

According to yet another exemplary embodiment of the present invention, a boiler for a steam generation apparatus may be set forth. In an exemplary embodiment, the boiler may be adapted to generate steam. The boiler may further include a first pressure relief device coupled to the boiler adapted to release steam at a first pressure level; and a second pressure relief device coupled to the boiler adapted to release the steam at a second pressure level, where the second pressure level is higher than the first pressure level, and the second pressure relief device is adapted to release pressure in the event of malfunction of the first pressure relief device.

BRIEF DESCRIPTION OF THE DRAWINGS

The foregoing and other features and advantages of the invention will be apparent from the following, more particular description of exemplary embodiments of the invention, as illustrated in the accompanying drawings. In the drawings, like reference numbers generally indicate identical, functionally similar, and/or structurally similar elements. The drawing in which an element first appears is indicated by the leftmost digits in the corresponding reference number. A preferred exemplary embodiment is discussed below in the detailed description of the following drawings:

FIG. 4 depicts a parts list table providing an exemplary list of components of the steam generation device of FIGS. 3A–C according to an exemplary embodiment of the present invention.

DETAILED DESCRIPTION OF EXEMPLARY EMBODIMENTS OF THE PRESENT INVENTION

Various exemplary embodiments of the invention are discussed in detail below including a preferred embodiment. While specific implementations are discussed, it should be understood that this is done for illustration purposes only. A person skilled in the relevant art can recognize that other components and configurations may be used without parting from the spirit and scope of the invention.

Figure 1:
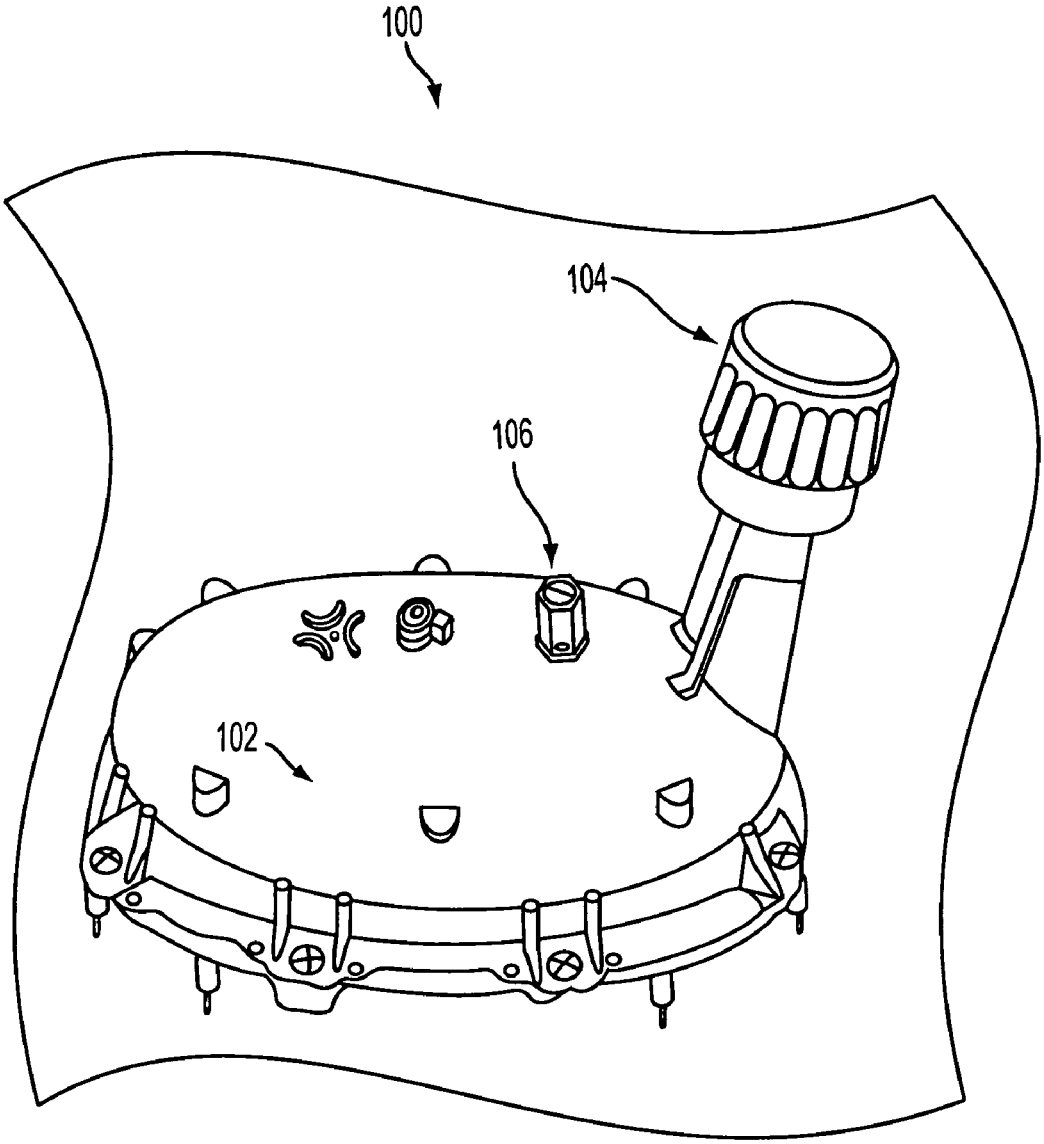
FIG. 1 depicts a boiler including dual high and low pressure relief valves in accordance with an exemplary embodiment of the present invention.

FIG. 1 depicts diagram 100 illustrating an exemplary embodiment of a boiler 102 having a first pressure relief device 104, and a second pressure relief device 106, according to an exemplary embodiment of the present invention. According to an exemplary embodiment, the first pressure relief device 104 may be placed in a filler cap as shown. In an exemplary embodiment, the first pressure relief device may be any of various conventional spring relief valve pressure release mechanisms which are well known. Further details of an exemplary pressure relief valve may be found in U.S. Pat. No. 4,168,723, the contents of which are incorporated herein by reference in their entirety. According to an exemplary embodiment, the first pressure relief device 104 may vent steam into the filler cap if pressure exceeds a first pressure level. According to an exemplary embodiment, the second pressure relief device 106 may be adapted to sense pressure reaching a second pressure level. According to an exemplary embodiment, the second pressure level may be a higher pressure level than the first pressure level and may act as a safety appartus to provide a backup to the first pressure release device 104 in the event of pressure release malfunction.

In an exemplary embodiment of the present invention, a safety device is set forth for the boiler 102. In one exemplary embodiment, the safety device may be used with a boiler 102 that is used in a steam application. In an exemplary embodiment of the present invention, the boiler 102 may be constructed out of material including, but not limited to, e.g., aluminum or stainless steel.

Conventionally, most steam boilers 102 used in steam cleaners and in iron steam stations, include only a single first pressure relief device 104 in a filler cap. This single pressure relief device may include a mechanical relief valve device with a spring, or other bias loaded release, biased to remain closed until a threshold pressure level is reached, causing venting of the gas or steam through a fluid port.

Conventionally, in steamers, a heating element heats water in the boiler 102. Conventional steamers also include a thermostat. The thermostat may include a temperature sensor and a control circuit. The thermostat may conventionally sense the temperature inside the boiler and when the temperature reaches a particular level, the heating element may be disconnected from the electrical power by the the control circuit. Temperature has a direct relationship with pressure, so as temperature rises, pressure rises. Thus the thermostat may act to prevent excess pressure buildup in the boiler 102.

The first pressure relief device 104 may come into play in the event of a malfunction such as, e.g., but not limited to, a thermostat malfunction. For example, if the thermostat malfunctions, in some cases, the fluid in the boiler may continue to heat and pressure might build inside the boiler 102. The first pressure relief device 104 may be set to release pressure at a calibrated pressure. If the first pressure relief device 104 reaches its calibrated pressure, steam may be released via the exemplary pressure relief valve in the filler cap, avoiding any harm to the boiler. An exemplary first pressure relief security cap may be calibrated to release steam at, e.g., but not limited to, approximately 4 Bar and 6 Bar. In another exemplary embodiment, the first pressure relief security device may have a calibrated pressure level of approximately 7 Bar.

Conventionally, if because of some malfunction, temperature continues to rise in the boiler, at some point a fuse may melt causing the heating element to become deenergized and stopping further heating. In an exemplary embodiment, a 172 degrees C. thermal fuse may be used. When a fuse melts down, the steam generating unit typically may become inoperative and the unit may need to be sent back to an authorized servicer to be serviced.

In the event of certain malfunctions (e.g., failure of the thermostat to cut off, failure of the fuse to cutoff power, or failure of the first pressure relief device 104 in the filler cap to release accumulated pressure), in some cases it might be possible that pressure could continue to build within the boiler. In such a case, conventionally, even with the many conventional safety mechanisms, a potentially dangerous situation might arise where pressure might continue to accumulate in the boiler. As a means of backup of the various other safety features of a steam generating device, an exemplary embodiment of the present invention provides a further security safeguard, by providing a secondary pressure relief device 106, as shown in FIG. 1 and FIG. 2.

Figure 2:
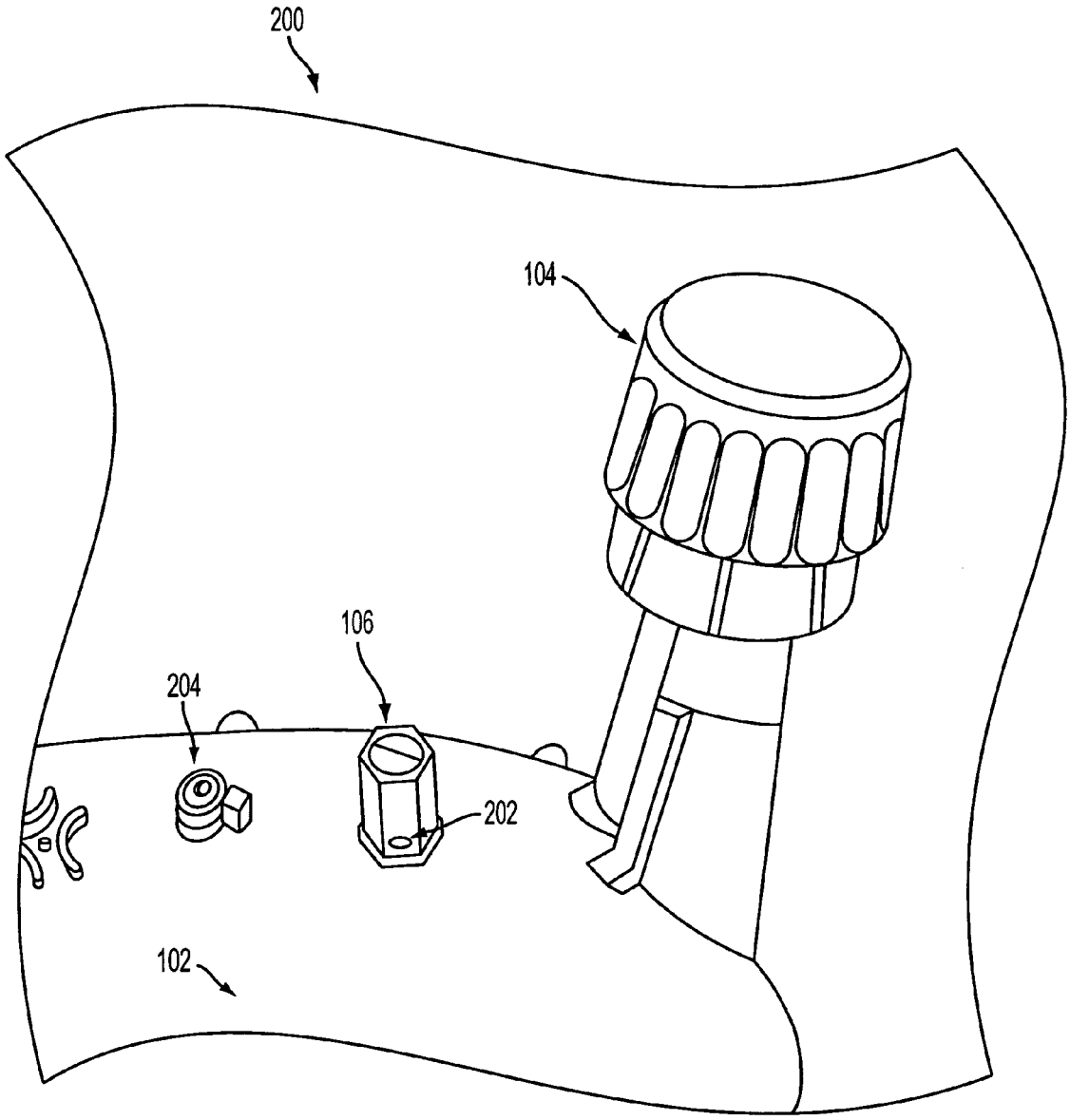
FIG. 2 depicts a blown up detail of the first and second pressure relief valves in accordance with an exemplary embodiment of the present invention.

As shown in more detail in FIG. 2, according to an exemplary embodiment of the present invention, a second steam relief device 106 may be added to the boiler 102. As shown, in an exemplary embodiment, the second pressure relief valve 106 may include a fluid port 202. As shown, in an exemplary embodiment, the second pressure relief device 106 may be an octagonal pressure relief device 106 which may be placed in the wall of boiler 102, as shown. In an exemplary embodiment, the secondary relief device 106 may be calibrated to release pressure at a higher pressure level than the first pressure level. As shown, in an exemplary embodiment, the second pressure relief device 106 may be a pressure release valve and may be placed on top of the boiler 102. According to an exemplary embodiment, the second pressure relief device 106 may be calibrated to release steam at a pressure higher than the pressure rating of the first pressure relief device 105. In an exemplary embodiment, the higher, second pressure level, at which the second pressure relief valve 106 may be calibrated to release pressure, may be, e.g., but not limited to, a pressure range of approximately, 10 Bar to 15 Bar. The second pressure relief device 106, in the exemplary embodiment, may provide another level of safety security to the boiler 102, in the event of pressure exceeding the first pressure level of the first pressure relief device 104.

The second pressure release device 106 may make the boiler 102 much more secure than conventional boilers used in conventional steamers. FIGS. 1 and 2 depict a steam boiler 102 with a conventional first pressure relief device 104 in a filler cap. FIG. 1 further depicts a second pressure relief device 106, having a fluid port 202, which in an exemplary embodiment may be made to vent steam into an outer housing of the steam generation device, upon pressure reaching a higher second pressure level, according to the present invention. FIG. 2 further illustrates at 204 an outlet which would normally be coupled to a hose and/or nozzle for steam use.

Figure 3A:
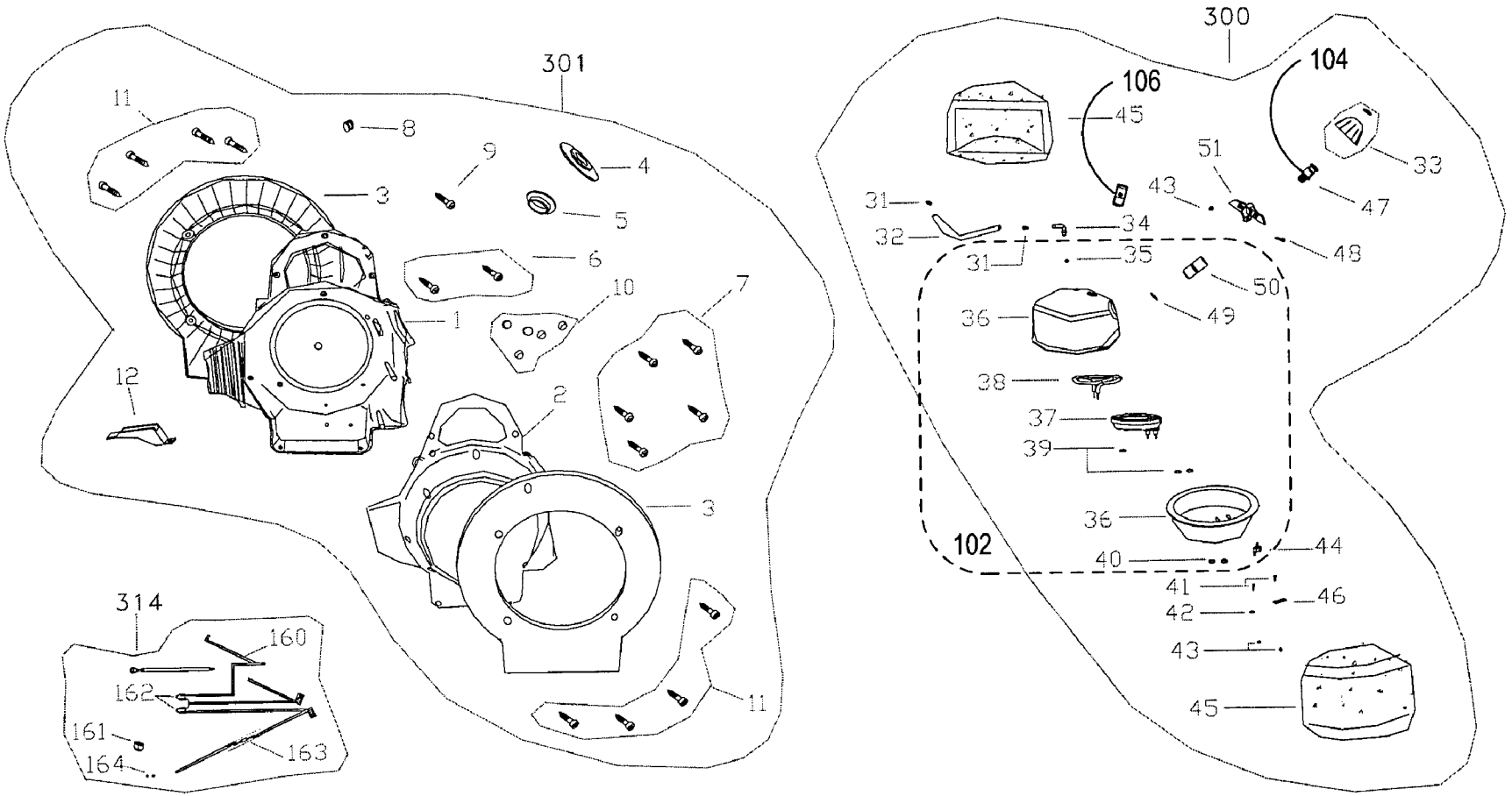
FIG. 3A depicts an exemplary boiler and a housing of an exemplary steam generation device having first and second pressure relief valves in accordance with an exemplary embodiment of the present invention.

FIG. 3A depicts an exemplary boiler 300 and a housing 301 of an exemplary steam generation device having first and second pressure relief valves in accordance with an exemplary embodiment of the present invention. Various exemplary components are illustrated and defined in the parts list table of FIG. 4. Boiler 300, in an exemplary embodiment, may include a boiler top 36, a boiler bottom 36, heating elements 37, 38, insulation 45, various o-rings, washers, and nuts. According to an exemplary embodiment, boiler 102 may include a first pressure relief device 104, in a filler cap 33, including, a 7 Bar security valve pressure relief device 104, and a second pressure relief device 106, including a higher pressure rating of e.g., 15 Bar. According to an exemplary embodiment, housing 301 may include right body portion 1, left body portion 2, windup covers 3 for receiving a power cord, and/or a hose, and various washers, screws, bearings and stoppers. As shown, a thermal fuse 163 may included, as well as a lamp 162 for indicating whether the heating element is heating.

Figure 3B:
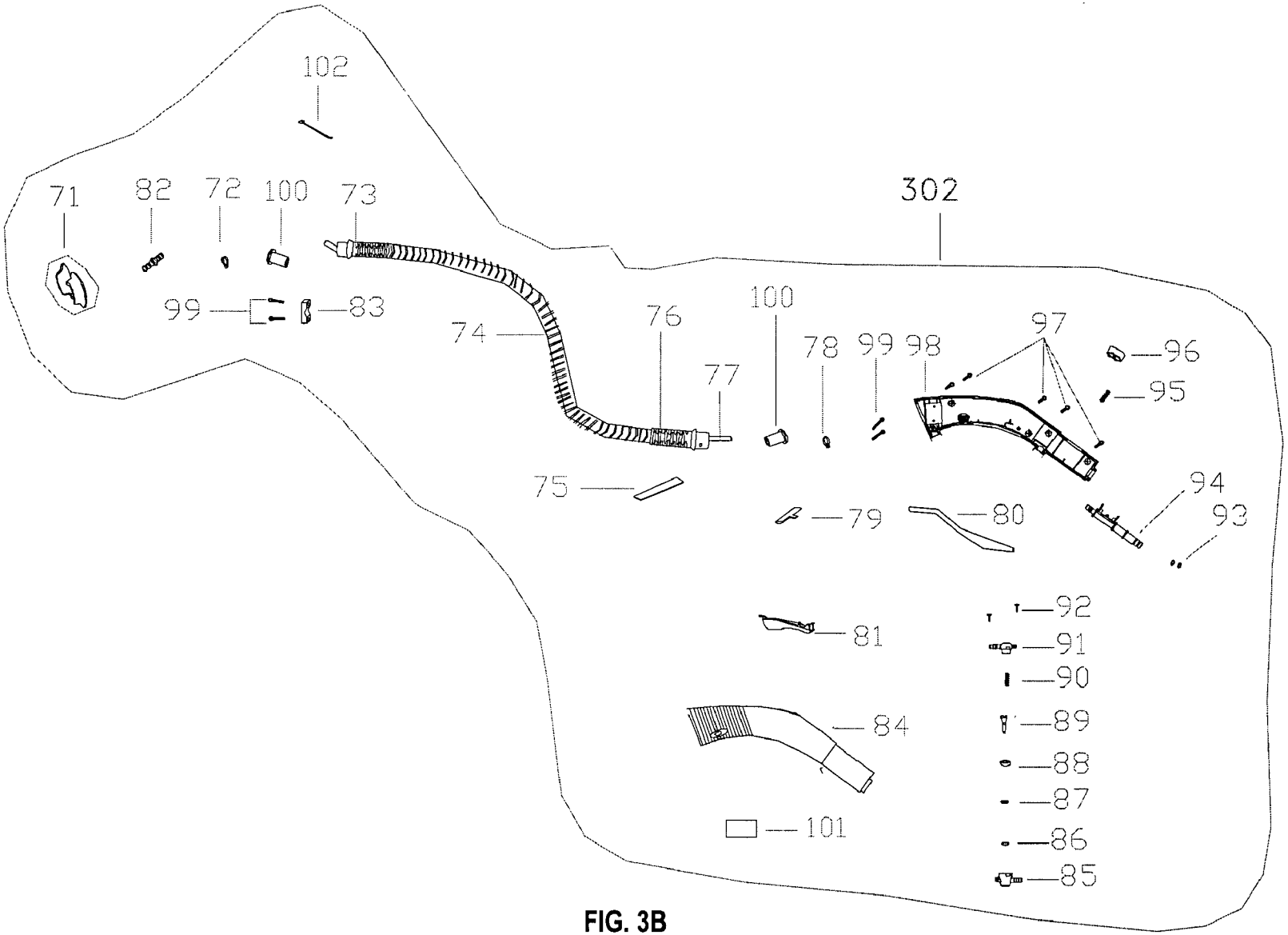
FIG. 3B depicts an exemplary hose group and handle having a trigger of a steam generation device in accordance with an exemplary embodiment of the present invention.

FIG. 3B depicts an exemplary hose group 302 and handle 84, 98 having a trigger 81 of a steam generation device in accordance with an exemplary embodiment of the present invention. Various exemplary components are illustrated and defined in the parts list table of FIG. 4. FIG. 3B, in an exemplary embodiment, includes a hose 74, a handle including a left handle cover 98, a right handle cover 84, a trigger 81, various valve covers, springs, pistons, o-rings, tubes, clamps, cables, lock washers, screws, clamps, flanges, couplings.

Figure 3C:
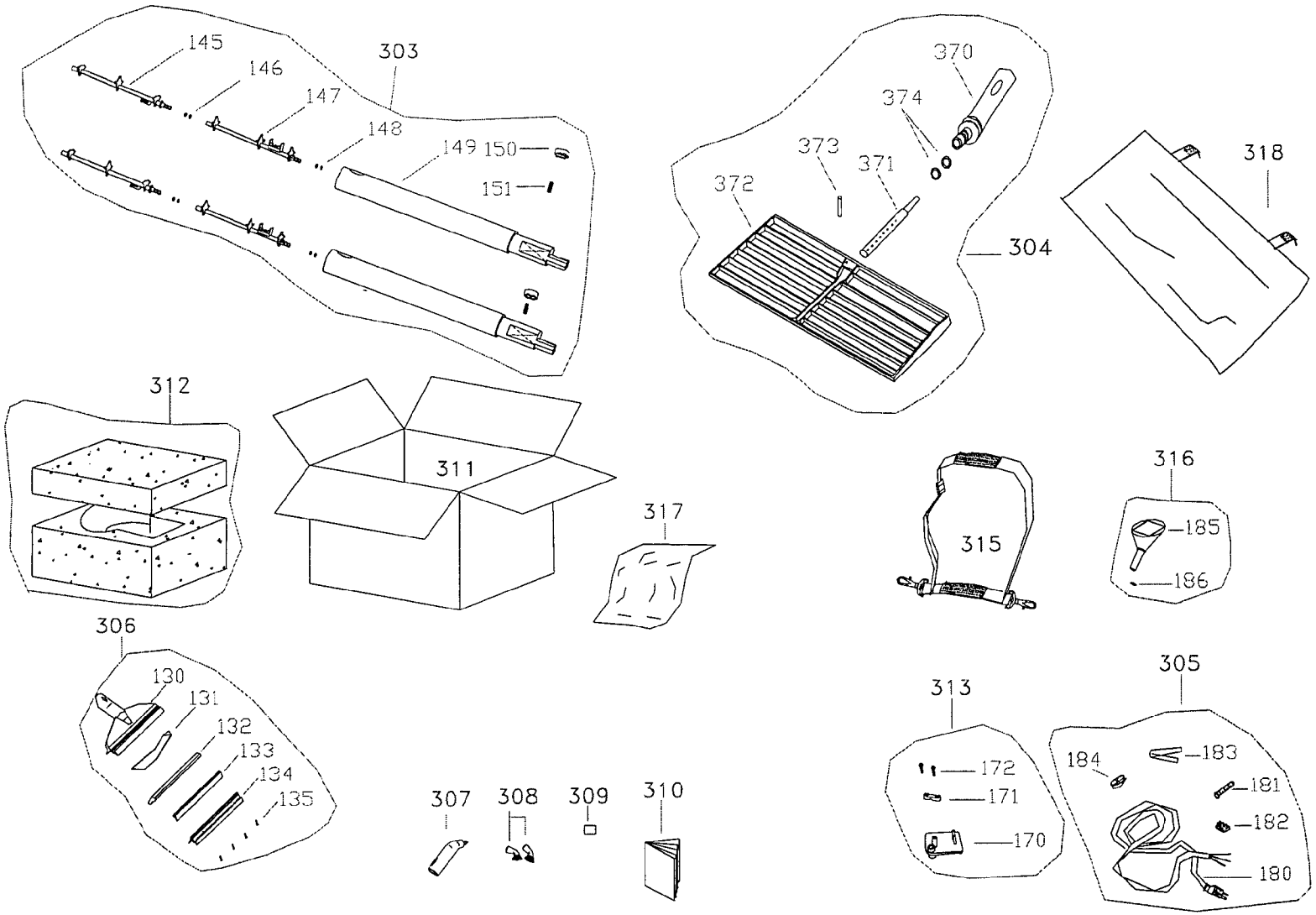
FIG. 3C depicts exemplary accessories including pipes, a steam pocket floor brush, a squeegee, a shoulder strap, a funnel, and packing materials in accordance with an exemplary embodiment of the present invention.

FIG. 3C depicts exemplary accessories including pipes 303, a steam pocket floor brush 304, a squeegee 306, a shoulder strap 315, a funnel 316, and packing materials 311, 312, 317 in accordance with an exemplary embodiment of the present invention. Various exemplary components are illustrated and defined in the parts list table of FIG. 4. In an exemplary embodiment, the steam generation device may include a floor brush 304 including a steam pocket towel 318 covering a steam pocket body 372 coupled to a steam pocket nozzle 371, with steam pocket lock pin 373, o-rings 374, and floor brush adapter 370. Advantageously, the floor brush is reversible, providing for double the surface area of a conventional floor brush. FIG. 3C further includes an exemplary pipe group 303 illustrating exemplary pipes 149, with inner pipe 145, 147, o-rings, button and spring. FIG. 3C further illustrates an exemplary squeegee 306 as may be used for cleaning, e.g., windows, floors, etc. Various accessories of the steam generation device are further illustrated including, e.g., a shoulder strap 315, a funnel 316, terminal socket group 313, and power cord 305. Further, exemplary packing materials may include sponge packing 312, box 311, and bag 317.

FIG. 4 depicts a parts list table providing an exemplary detailed list of exemplary, but not limiting, components of the exemplary steam generation device of FIGS. 3A–C according to an exemplary embodiment of the present invention.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents. While this invention has been particularly described and illustrated with reference to a preferred embodiment, it will be understood to those having ordinary skill in the art that changes in the above description or illustrations may be made with respect to formal detail without departing from the spirit and scope of the invention.

What is claimed is:

1. A steam generation apparatus comprising:
- a housing;
- a boiler for generating steam within said housing;
- a filler cap adapted to be removably coupled to said boiler;
- a first pressure relief device coupled to said boiler adapted to release steam at a first pressure level; and
- a second pressure relief device coupled to said boiler adapted to release the steam at a second pressure level, wherein the second pressure level is higher than the first pressure level,
  - said first pressure relief device is incorporated into and is made to vent into said filler cap, and
  - said second pressure relief device is made to vent internal to said housing.

2. The apparatus of claim 1, wherein said boiler comprises at least one of:
- stainless steel; or
- aluminum.

3. The apparatus according to claim 1, wherein said first pressure relief device comprises a spring type pressure release valve.

4. The apparatus according to claim 1, wherein said second pressure relief device comprises a brass octagon valve threaded into a wall of said boiler.

5. The apparatus according to claim 1, wherein said boiler is part of at least one of:
- a steam cleaner; or
- an iron steam station.

6. The apparatus according to claim 1, wherein the first pressure level comprises: approximately 4 Bar to 6 Bar.

7. The apparatus according to claim 6, wherein the second pressure level comprises: approximately 10 Bar to 15 Bar.

8. The apparatus according to claim 1, wherein the second pressure level comprises: approximately 10 Bar to 15 Bar.

9. The apparatus according to claim 1, further comprising:
- a thermostat comprising a temperature sensor proximate to said boiler and a control system adapted to shutoff a heating element of said boiler upon sensing a threshold temperature proximate said boiler.

10. The apparatus according to claim 1, further comprising:
- a fuse proximate to said boiler adapted to cutoff power to a heating element of said boiler if a temperature in excess of a fuse melting temperature is exceeded.

11. The apparatus according to claim 1, further comprising:

a water level sensor adapted to cutoff power to a heat element proximate to said boiler if a water level in said boiler falls below a threshold water level.

12. The apparatus according to claim 1, further comprising:

a hose coupled to said boiler at an outlet; and a nozzle coupled to said hose.

13. The apparatus according to claim 12, wherein said nozzle comprises:

a steam pocket nozzle;

a steam pocket body; and a steam pocket towel.

14. A boiler for a steam generation apparatus comprising:

a boiler for generating steam;

a first pressure relief device coupled to said boiler adapted to release steam at a first pressure level; and a second pressure relief device coupled to said boiler adapted to release the steam at a second pressure level, wherein the second pressure level is higher than the first pressure level, and said second pressure relief device is adapted to release pressure in the event of malfunction of said first pressure relief device.

* * * * *